US006216945B1

(12) United States Patent
Gabrielli et al.

(10) Patent No.: US 6,216,945 B1
(45) Date of Patent: Apr. 17, 2001

(54) POURING ELEMENT

(75) Inventors: Mario Gabrielli, Krefeld; Christoph Mehler, Monchengladbach; Matthias Dammers, Alsdorf; Michael Noppeney, Julich-Kaslar, all of (DE)

(73) Assignee: SIG Combibloc GmbH & Co. KG, Linnich (DE)

( * ) Notice: Subject to any disclaimer, the term of this patent is extended or adjusted under 35 U.S.C. 154(b) by 0 days.

(21) Appl. No.: 09/194,643

(22) PCT Filed: May 29, 1997

(86) PCT No.: PCT/EP97/02801

§ 371 Date: Aug. 13, 1999

§ 102(e) Date: Aug. 13, 1999

(87) PCT Pub. No.: WO97/46455

PCT Pub. Date: Dec. 11, 1997

(30) Foreign Application Priority Data

Jun. 1, 1996 (DE) ..... 196 22 144

(51) Int. Cl.[7] ..... B65D 17/30; B65D 51/22

(52) U.S. Cl. ..... 229/204; 229/129.08; 220/258

(58) Field of Search ..... 222/541.2, 541.6, 222/541.7, 541.8, 566; 220/258, 279; 229/204, 129.08

(56) References Cited

U.S. PATENT DOCUMENTS

| | | | | |
|---|---|---|---|---|
| 4,018,357 | * | 4/1977 | Ostrem | 222/541.2 |
| 4,463,866 | | 8/1984 | Mandel | 220/269 |
| 4,915,290 | | 4/1990 | Robichaud et al. | 229/125.08 |
| 4,925,034 | | 5/1990 | Robichaud et al. | 206/603 |
| 4,930,683 | * | 6/1990 | Farber | 220/258 |
| 4,934,590 | * | 6/1990 | Robichaud et al. | 229/125.09 |
| 4,988,012 | * | 1/1991 | Shastal | 220/258 |
| 5,101,999 | * | 4/1992 | Robichaud et al. | 220/258 |
| 5,832,698 | | 11/1998 | Huguenin | 45/451 |
| 5,875,959 | * | 3/1999 | Weiteder et al. | 229/204 |
| 5,947,316 | * | 9/1999 | Guillonnet | 229/204 |

FOREIGN PATENT DOCUMENTS

| | | |
|---|---|---|
| 0 577 865 | 1/1994 | (EP) . |
| PCT/US90/01656 | 3/1990 | (WO) . |
| WO92 00884 | 1/1992 | (WO) . |

* cited by examiner

*Primary Examiner*—Kevin Shaver
*Assistant Examiner*—Eric Keasel
(74) *Attorney, Agent, or Firm*—Standley & Gilcrest LLP

(57) ABSTRACT

A pouring element for attachment to a package containing flowable material, and having a pouring opening covered with a perforated or otherwise weakened material. The pouring element of the present invention allows for the opening of the package without contamination of the contents therein.

In one embodiment of the pouring element, there exists an opening means that has an attached support element and which is hinged to a base plate portion of the pouring element. In conjunction with movement of a lid portion, the support element and opening means act to penetrate a tearable material covering a pouring opening of the package, thereby allowing the contents thereof to be dispensed. In another embodiment, the opening means may be a portion of the support element and may be affixed to the lid. After initial opening of the lid, the support element may position itself such that closing of the lid will cause penetration of the tearable material layer by the opening means, and thus the opening of the package.

The opening means and support element are kept covered by the lid, which also functions to seal the pouring aperture when closed. Once the package is opened, both the support element and the opening means are placed in such a position that pouring of the contents of the package is not impeded.

15 Claims, 7 Drawing Sheets

POURING ELEMENT

BACKGROUND AND SUMMARY OF THE INVENTION

The present invention relates to a pouring element adapted for attachment to a package via a base plate. The pouring element contains a pouring aperture, which after attachment, is designed to reside essentially congruent with a pouring hole formed in the package. The present invention contemplates attachment to a package having a tearable material layer covering the pouring hole located therein. A lid is hingedly attached to the base plate. The underside of the lid preferably contains a sealing structure for sealing the pouring aperture. An opening means is hingedly attached to the interior of the pouring aperture and extends essentially along the length thereof, such that, prior to the opening of the package, the opening means is maintained in a position relatively parallel to the tearable material layer covering the pouring hole. A support element may be hingedly attached to, and may extend from a top surface of the opening means. The tearable material layer covering the pouring hole can be torn by pressing the lid against the support element, which in turn causes the opening means to be pushed through the tearable material layer and into the package.

Pouring elements of this type are commonly used on packages containing free-flowing materials, such as cold, cold-sterile, hot, and aseptic liquids. Such packages commonly assume the form of cuboid flat-gabled cartons. These cartons are frequently constructed from a composite material comprising a carrier layer of paper or cardboard, a bonding agent layer, and a barrier layer (particularly of aluminum), with a plastic layer on both sides.

A known pouring element is described in the German published application DE 44 09 947 A1. The pouring element disclosed therein has a base plate, which allows the pouring element to be glued to a package. A lid is hingedly attached to the base plate. A cutting device is attached to the side of the lid, such that when the lid is hinged in the direction of the package the cutting device tears open an opening surface located thereon. While this known pouring element provides ease of use, it has the disadvantage of creating a relatively small pouring aperture. A further, and more significant disadvantage results from the cutting device being permanently attached to the lid. As the lid is also used to seal the package, each time the lid is swiveled anew into and out of the package, there exists the danger that the contents of the package will become polluted with contaminants that may collect at the free, upper-side of the lid.

An additional known pouring element of this type can be seen in the British patent application GB 2 267 896 A. In this known pouring element, an opening means is designed as a plate element hingedly connected with a rim of the pouring element. With the opening surface of the package to which the pouring element is attached untorn, the plate element is arranged in the pouring aperture and rests on the opening surface. During storage of the unopened package, the lid covers the pouring aperture so that contamination of the pouring aperture, the opening means, and the opening surface is safely avoided. However, in order to open the package, it is necessary to force the plate element through the material of the opening surface and into the package by applying pressure with a finger of the hand. In this manner, the plate element takes with it the respectively perforated opening surface material. Unfortunately, this method allows for the possibility that contamination adhering to the skin of the finger may enter the package or otherwise be lodged in the pouring aperture, thereby contaminating the contents of the package during the opening process or during the later pouring of the contents.

A similar pouring element is shown in WO 90/14280. The pouring element utilizes an element rigidly arranged on the lid to drive an opening means into the package to which the pouring element is attached. This pouring element is disadvantageous in regard to both its hygiene and its function. The opening element for pushing in the opening aperture of the package is rigidly hinged to the lid, and thus unprotected during transport and storage. Although contact with a finger is avoided in this invention, because of its complicated geometric shape, the opening element may trap contaminants, and therefore, may still possibly contaminate the contents of the package during the opening process. This pouring element is also functionally disadvantageous, because during the opening process the opening element is hinged through almost 180 degrees of rotation. To achieve this rotation, the composite portion of the package at the package opening aperture must also be bent by approximately the same amount. Such bending may result in restoring forces that may lead to separation of the pouring element from the package.

It is an object of the present invention to provide an improved pouring element of the type above-described, whereby the opening process of the package is simplified, and whereby the opening process is conducted hygienically so that the contents of the package are not contaminated.

According to the present invention, this object may be achieved through the use of a support element for assisting in the operation of an opening means. The support element is designed to be in communication with the opening means, and upon the first opening of the lid, to automatically raise itself into the hinged path thereof. The lid and the support element are thereby releasably coupled upon the moving of the lid to its closed position. Therefore, upon closing for the first time, the lid will contact the support element and thereby cause the opening means to penetrate the tearable material layer and enter the pouring hole of the package. Thus, a simple and hygienic opening of the package may be achieved.

In one embodiment of the pouring element of the present invention, with the package yet unopened, the opening means is arranged to reside in a pouring aperture and to be hingedly connected to a base plate. Preferably, a support element is integrally attached via a film hinge to an opening means in one piece and is retained in a position substantially parallel to the surface of the package, between the opening means and a lid. Therefore, when the lid is in a closed position, the support element is retained in a pre-tensioned position. In this design, during storage and transport of the package the pouring aperture is sealed by the lid.

Upon the first opening of the lid, the support element raises itself automatically into the hinged path of the lid. Subsequently, when the lid is later closed it will meet the raised support element attached to the opening means, and upon continued movement will cause the opening means to penetrate the tearable material layer covering the pouring hole of the package. After penetration, both the opening means and the support element will remain in a substantially vertical position, protruding into the package. However, because both the opening means and the support element were protected from contaminants during storage and transport, the contents of the package are not at risk of contamination by contact therewith.

Unhindered pouring of the contents of the package may be ensured, by providing a retaining device on the support element that automatically compresses during insertion of the support element into the pouring hole of the package. Once the opening means is completely inserted into the pouring hole, the retaining device automatically spreads apart in such a manner that its free end is supported by the interior of the package, thereby maintaining the inserted position of both the support element and the opening means within the package.

Alternately, or in addition to providing a retaining device on the support element, a catch element may be provided on the opening means to hold the opening means in an inserted position after the opening of the package. In this way, any potential obstruction to the pouring of the package contents by the opening means may be avoided.

The pouring element of the present invention can be of simplified design. For example, the bottom surface of the lid may have a circumferential ridge for sealing the pouring aperture when in a closed position. This circumferential ridge may also serve as a limit stop for the support element. Thus, portions of the pouring element may have multiple functions.

In an alternate embodiment of the present invention, the pouring element may have a support element attached to the lid. In this embodiment, with the lid closed and the package unopened, the support element resides between the lid and the opening means. Upon opening of the lid, the support element automatically extends itself out therefrom. Thus, upon a first closing of the lid with the support element so extended, the support element will contact the opening means present in the pouring aperture, thereby forcing the opening means to penetrate the tearable material layer and extend into the pouring hole of the package. The opening means may remain in this inserted position, while the support element will be removed upon re-opening of the lid.

The opening means may also be formed onto the free end of the support element, thereby ensuring that even under unfavorable conditions, the opening means will be guided into the pouring aperture by the support element during closing of the lid. Such attachment is particularly effective if, for example, the opening means is designed to be substantially in the shape of an arrowhead. Such a design is also favorable to a reduction in production costs, as the support element and lid may be formed as a single component.

To avoid interference with the pouring of the contents of the package by the support element, it is preferable in this embodiment that the support element have the ability to be retained within the lid. The support element may be hinged into the underside of the lid, such that after the opening of the package, the support element may be snapped into a non-interfering position therein. Alternatively, or additionally, the support element may also be designed to be detachable from the lid. Each of the above designs helps to avoid the possibility of dirt collecting at the support element and entering the package.

Although not essential, preferably, the support element is bar shaped. A bar shaped support element efficiently allows the force required to open the package to be safely transmitted from the lid to the opening means.

BRIEF DESCRIPTION OF THE DRAWINGS

In addition to the novel features and advantages mentioned above, other objects and advantages of the present invention will be readily apparent from the following descriptions of the drawings and embodiments, wherein.

DETAILED DESCRIPTION OF THE PREFERRED EMBODIMENT(S)

Figure 5:
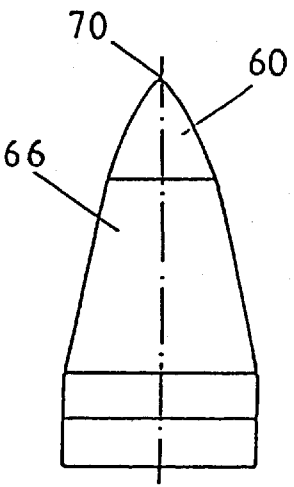
FIG. 5 is a front view depicting the support element shown affixed to the lid of the pouring element in FIG.'s 3 and 4.
Figure 6:
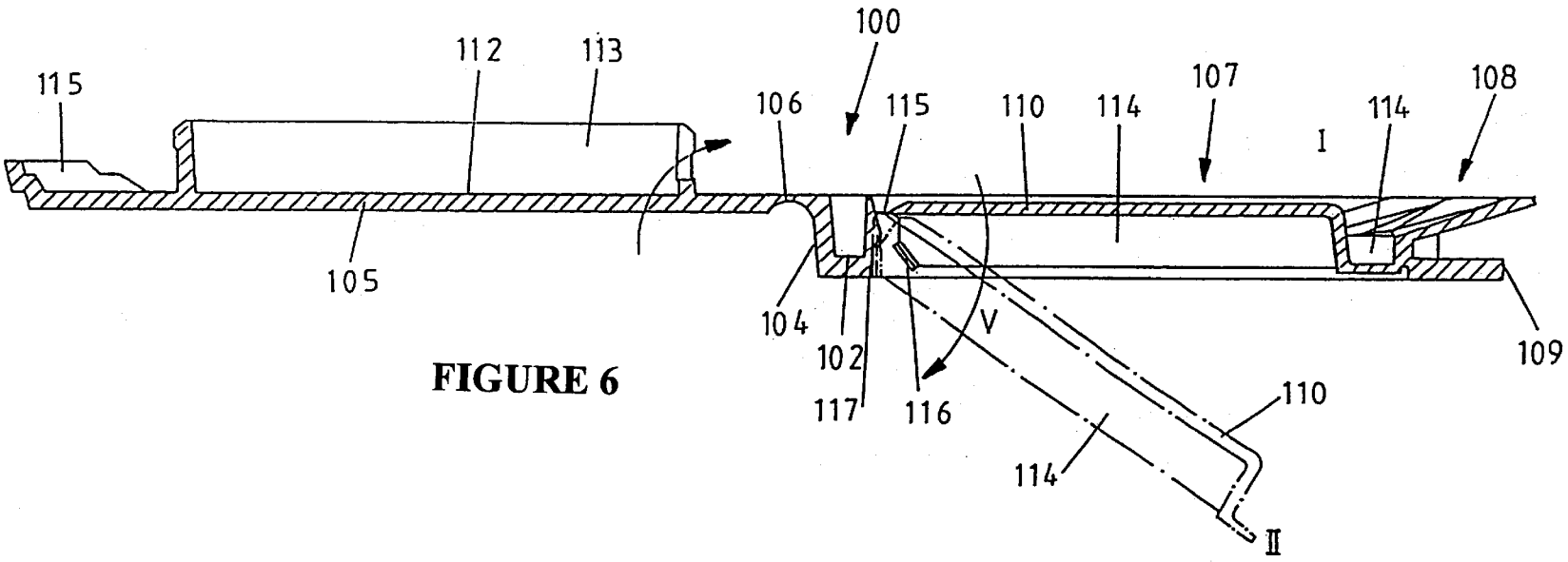
FIG. 6 is a lateral view, in cross-section, of another embodiment of a pouring element of the present invention in an open position.
Figure 7:
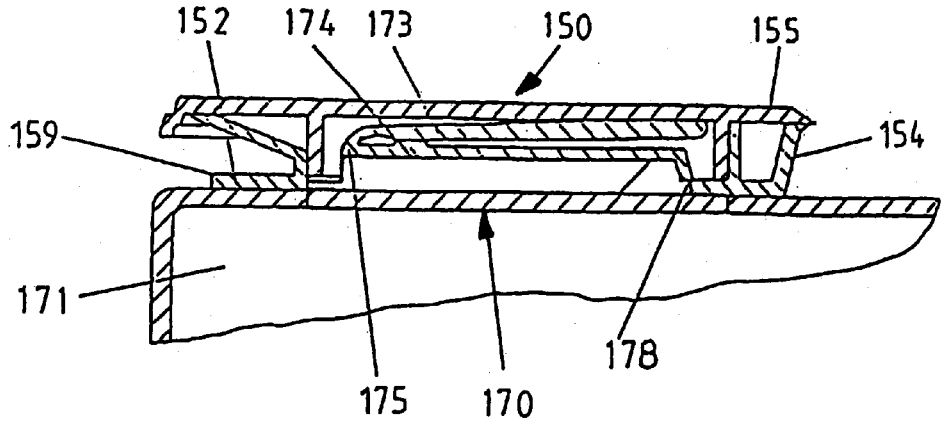
FIG. 7 is a lateral view, in cross-section, of still another embodiment of a pouring element of the present invention, shown here attached to an unopened package with its lid closed.
Figure 8:
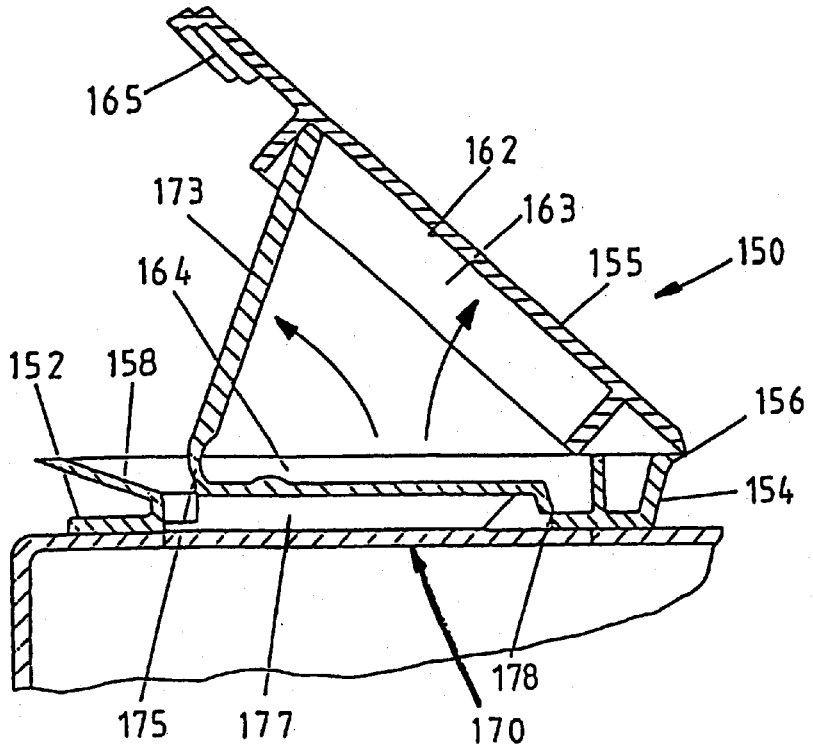
FIG. 8 shows the pouring element of FIG. 7, but with the lid in an open position and with a support element extended.
Figure 9:
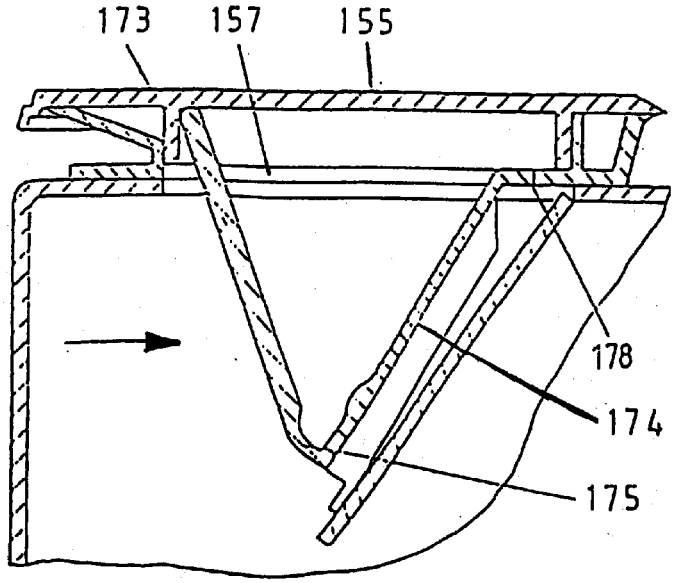
FIG. 9 illustrates the pouring element of FIGS. 7 and 8, wherein the package has been opened by using the lid to drive the support element and an opening means through a pouring opening therein.
Figure 10:
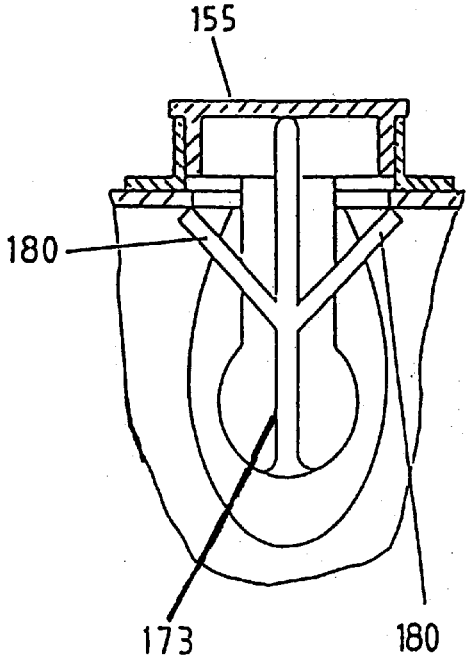
FIG. 10 is a rear view of the package and pouring element of FIG. 9, in partial cross-section, illustrating the position of the opening means within the package after the opening thereof.

The pouring elements 1, 50, 100, 150 shown in FIGS. 1–10 are preferably made from a plastic material and all possess a base plate 2, 52, 102, 152 with an essentially rectangular shape. On one of the shorter sides 4, 54, 104, 154 of each of the base plates 2, 52, 102, 152 a lid 5, 55, 105, 155 is formed integrally therewith. A film hinge 6, 56, 106, 156 is used to connect the lid 5, 55, 105, 155 to the respective base plate 2, 52, 102, 152, such that the lid may rotate from the open position shown in FIGS. 1–4, 6 and 8 to a closed position in which the lid rests against the base plate as shown in FIGS. 7, 9 and 10.

A pouring aperture 7, 57, 107, 157 having a pouring spout 8, 58, 108, 158 is formed into each base plate 2, 52, 102, 152. The mouth of each pouring spout 8, 58, 108, 158 is preferably located along the short side 9, 59, 109, 159 of each base plate 2, 52, 102, 152 opposite the film hinge 6, 56, 106, 156.

A rim 13, 63, 113, 163 is preferably located on the underside 12, 62, 112, 162 of each lid 5, 55, 105, 155 and is preferably shaped so that when the lid is closed, the periphery of the rim will rest flush against the inside of an edge 14, 64, 124, 164 of the pouring aperture 7, 57, 107, 157. In addition, a catch 15, 65, 115, 165 is preferably formed on the unhinged, short side of the lid 5, 55, 105, 155. With the lid 5, 55, 105, 155 closed, the catch 15, 65, 115, 165 snaps over and encompasses the pouring spout 8, 58, 108, 158, thereby preventing any unintentional opening of the pouring element 1, 50, 100, 150.

FIGS. 1–5 show the state of the pouring elements 1, 50, 100, 150 after the initial opening of the lid 5, 55, 105, 155, and prior to the opening of the package. Referring specifically to the embodiment of the pouring element 1 of FIGS. 1 and 2, an opening means 10 is shown to extend within a pouring aperture 7 and to be connected to a base plate 2 by an opening means film hinge 11. In this embodiment, the opening means 10 acts as a pressure plate, and contains a cutting device (not shown) on its underside. A substantially bar shaped support element 16 can be seen to be integrally formed onto a top, frontal portion of the opening means 10, by way of a support element film hinge 17.

Figure 1:
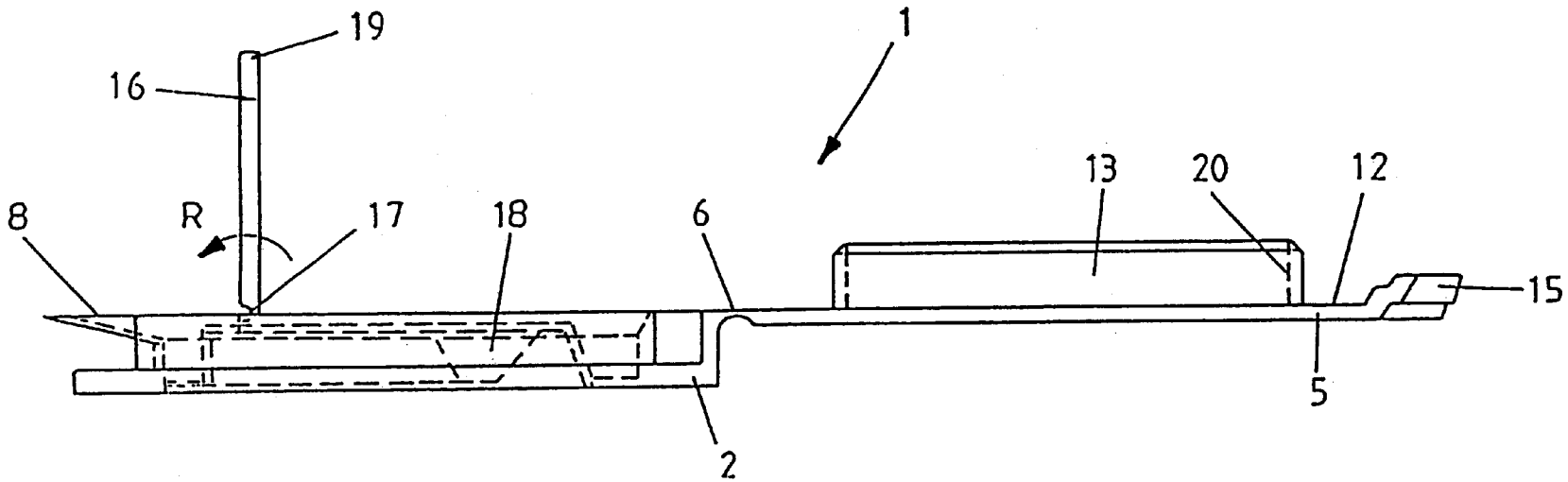
FIG. 1 is a lateral view showing a pouring element of the present invention in an open position.
Figure 2:
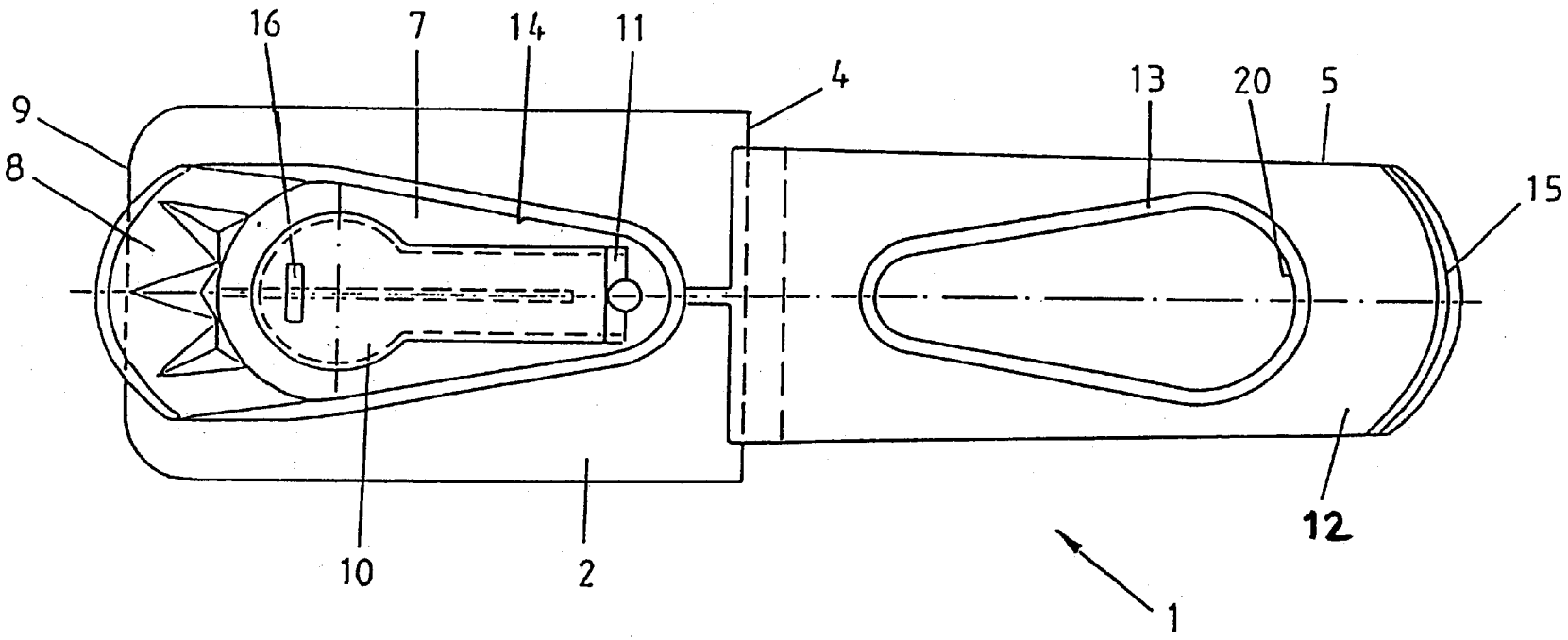
FIG. 2 is a top view of the pouring element of FIG. 1.

Prior to the first opening of the package, the lid 5 is in a closed position, thereby sealing the pouring aperture 7 and the pouring spout 8. With the lid 5 in this position and the package unopened, the support element 16 resides in a position essentially parallel to the surface (not shown) of the package, in between the opening means 10 and the underside 12 of the lid. In this hinged position, a restoring force R is created about the axis of the support element film hinge 17, such that the support element 16 will automatically move into a raised position (as shown in FIGS. 1–2) upon the initial opening of the lid 5. As shown in FIGS. 1–2, the support element 16 may assume a position substantially perpendicular to the opening means 10 and base plate 2.

Upon closing of the lid 5 on the as yet unopened package, the free end 19 of the support element 16 will enter the space defined by the inner periphery of the rim 13. Upon further closing of the lid 5, the free end 19 of the support element 16 will contact and be moved along the underside 12 of the lid until it becomes wedged against a frontal, interior portion 20 of the rim 13. Continued movement of the lid 5 will cause an opening force to be passed through the support element 16 to the opening means 10, thereby causing the opening means to penetrate a tearable material layer covering a pouring opening (not shown) and enter the package. When fully closed, the lid 5 will rest tightly against the pouring aperture 7 and pouring spout 8.

When the lid 5 is next opened, the opening means 10 and the support element 16 will remain in a position protruding into the package. Elastic forces present in the support element film hinge 17 will tend to cause the free end 19 of the support element 16 to move further into the package, thereby preventing any obstruction of the pouring opening during dispensing of the package contents.

Figure 3:
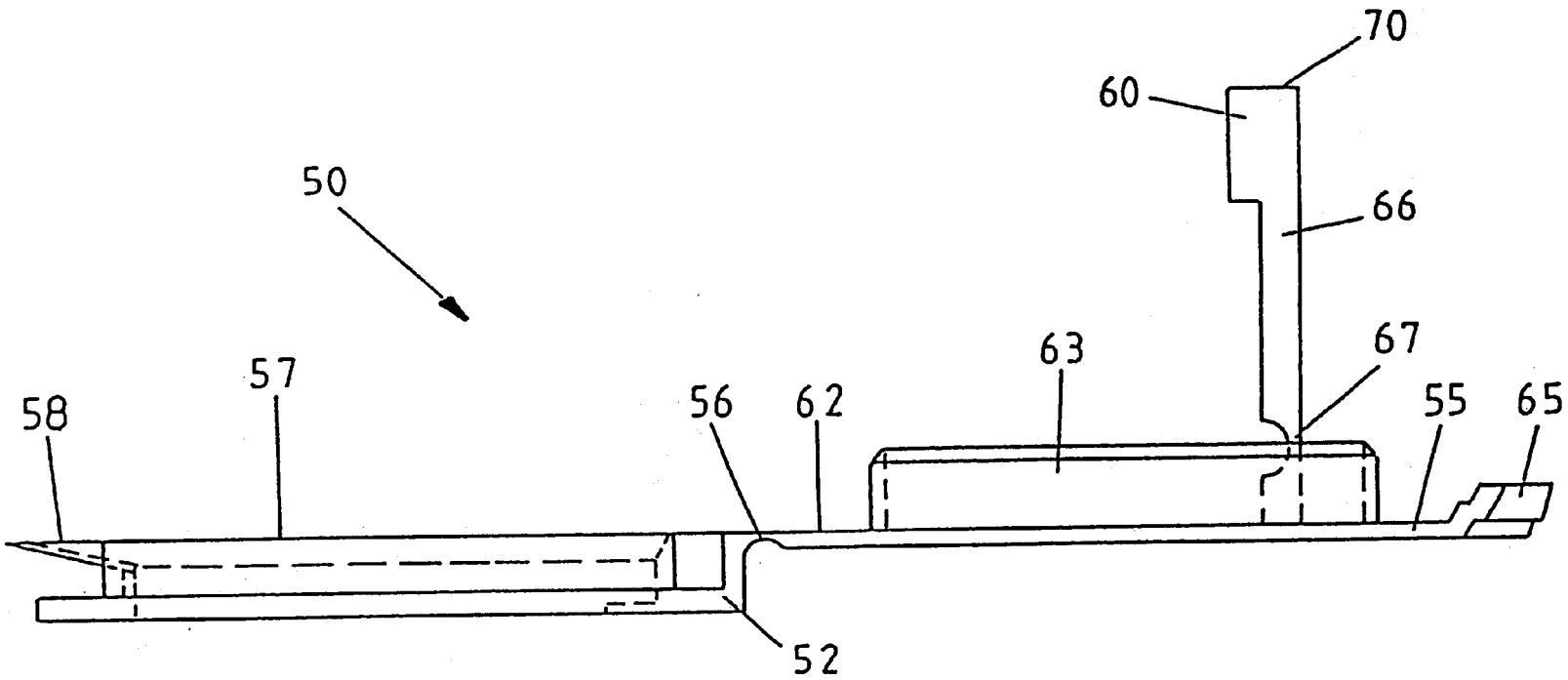
FIG. 3 is a lateral view showing an alternate embodiment of a pouring element of the present invention in an open position, wherein a support element is attached to the underside of a lid.
Figure 4:
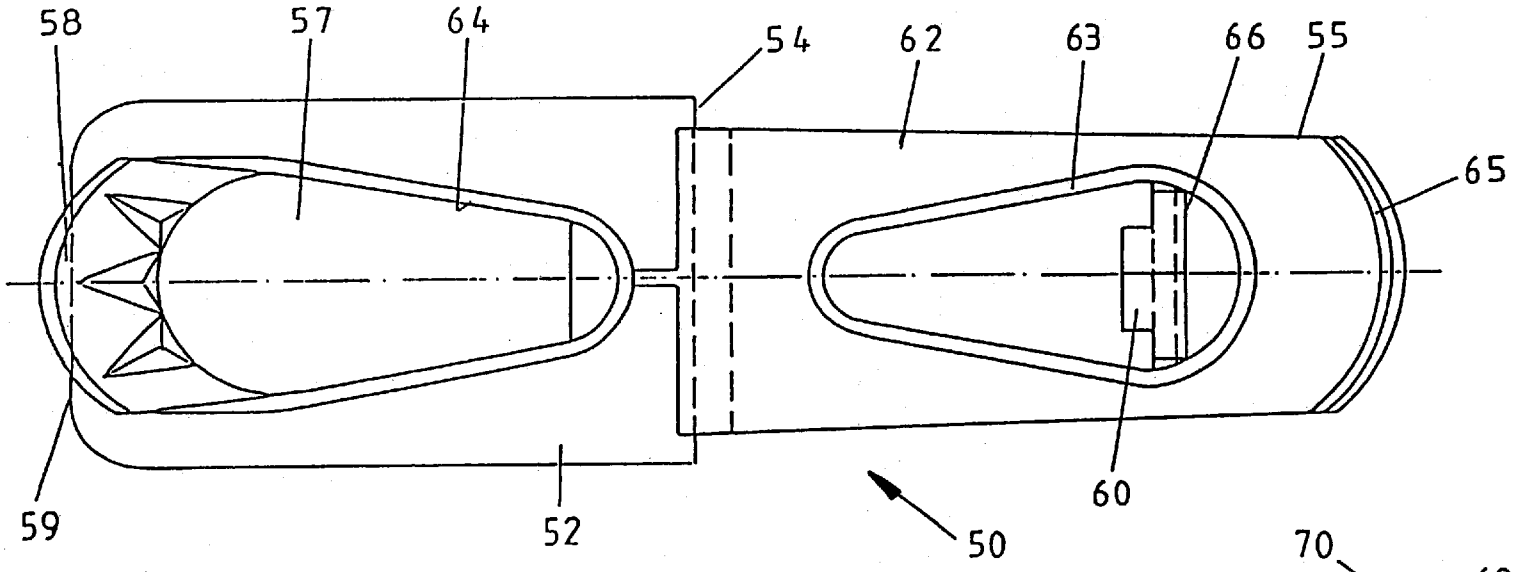
FIG. 4 is a top view of the pouring element of FIG. 3.

In the alternate embodiment of the pouring element 50 of the present invention shown in FIGS. 3–5, a support element 66 is preferably constructed substantially in the shape of an arrowhead. The support element 66 is preferably integrally formed with the lid 55, and attached thereto along a support element film hinge 67 that joins the widened section of the support element to a portion of the underside 62 of the lid located within a frontal portion of the interior of a rim 63. This connection allows the support element 66 to rotate along the support element film hinge 67 and into the space delineated by the rim 63.

An opening means 60 having a cutting device 70, is formed along a thickened portion of the free end of the support element 66 and extends along the length thereof. Prior to the opening of the package, the lid 55 is in a closed position, thereby sealing the pouring aperture 57 and the pouring spout 58. With the lid 55 in this position and the package unopened, the support element 66 and opening means 60 reside in a position essentially parallel to and in between the surface (not shown) of the package and the underside 62 of the lid. Upon the first opening of the lid 55, restorative forces in the support element film hinge 67 will cause the support element 66 and the opening means 60 to automatically rotate away from the underside 62 of the lid and into a raised position. As shown in FIGS. 3-4, the support element 66 and opening means 60 may assume a position substantially perpendicular to the underside 62 of the lid 55.

Upon closing of the lid 55 on the as yet unopened package, the opening means 60 is guided into the pouring aperture 57 of the pouring element 50. Continued movement of the lid 55 will cause the cutting device 70 of the opening means 60 to penetrate a tearable material layer covering a pouring opening (not shown) and enter the package. The arrowhead shape of the support element 66 helps to ensure that the greatest possible widening of the pouring opening is achieved. When fully closed, the lid 55 will rest tightly against the pouring aperture 57 and pouring spout 58.

Upon re-opening of the lid 55, the support element 66 and integral opening means 60 may be rotated back against the underside 62 of the lid and retained in this position. In this way, pouring of the package contents is not impeded by either the support element 66 and opening means 60.

Another embodiment of the pouring element of the present invention is depicted in FIG. 6. In this embodiment, two hinged positions I and II of an opening means 110 are shown. Although used in this embodiment, for purposes of clarity, a support element has been omitted from FIG. 6. The opening means 110 is preferably constructed to be similar to a lid element, in that when the package to which the pouring element is attached is still unopened, the opening means resides substantially parallel to the package surface and is aligned substantially with the upper edge of the pouring aperture 107. The opening means 110 is preferably provided with a cutting ridge 114 on its underside.

The opening means 110 is hingedly connected to the base plate 102 of the pouring element 100 by way of an opening means film hinge 115. The opening means film hinge 115 allows the opening means 110 to penetrate a tearable material layer covering a pouring opening (not shown) in the package during its movement V caused by closing the lid 105 against a support element (not shown).

Once the opening means is in a position II inside the package, it is held in position by catches 116 formed at the end of the cutting ridge 114 near the rear, short side 104 of the base plate 102. The catches 116 are designed to engage with catching protrusions 117 formed along a rearward interior edge of the pouring aperture 107.

Still another embodiment of a pouring element 150 can be seen by reference to FIGS. 7–10. The pouring element 150 is shown to be attached to an unopened package 171 having a pouring opening 170 closed off by a perforated section of the composite package material. In this unopened state the lid 155 rests substantially against the base plate 152, thereby sealing the pouring aperture 157 and pouring spout 158 from the outside environment.

A preferably bar-shaped support element 173 is integrally formed with the opening means 174, and is connected to a frontal portion thereof by means of a support element film hinge 175. The support element 173 is preferably provided with laterally-protruding, flexible branches 180, which radiate outward from approximately the center point of the support element toward the direction of the front of the support element.

The opening means 174 is configured similarly to a lid element and is preferably shaped to fit within the pouring aperture 157. A cutting ridge 177 is provided on the underside of the opening means 174 for contacting and penetrating the pouring opening 170 of the package 171. The opening means 174 is preferably integrally formed with the base plate 152 and connected thereto by means of an opening means film hinge 178.

As can be seen in FIG. 7, prior to opening of the package 171, and with the lid 155 still closed against the pouring aperture 157, the support element 173 resides substantially parallel to the top surface of the package 171 and in between the underside 162 of the lid and the top surface of the opening means 174. However, upon opening the lid 155, the elastic force present in the support element film hinge 175 will cause the support element 173 to automatically raise upward to a position extending outward from the pouring aperture 157 as shown in FIG. 8.

Upon closing of the lid 155, the free end of the support element 173 will eventually engage with the inner wall of a frontal portion of a rim 163 located on the underside of the lid. Further closing of the lid 155 imparts enough force to the support element 173 to subsequently cause the connected opening means 174 to penetrate the perforated section of the composite package material covering the pouring opening 170, and thereby enter the package. A large portion of the support element 173 is also caused to enter the package 171.

The flexible branches 180 of the support element 173 are compressed toward its main portion as they pass through the narrower lateral spacing of the pouring opening 170 edges. Upon clearing the edges of the pouring opening 170, the elastic forces within the flexible branches 180 cause a spreading thereof, effectively locking the support element 173 into the inserted position in the package 171 (see FIG. 10).

What is claimed is:

1. A pouring element for attachment to a package, said pouring element comprising:

a base plate;

a pouring aperture, said pouring aperture designed to be located congruent with an opening surface on said package upon proper attachment thereto;

a lid hingedly connected to said base plate;

an opening means for penetrating said opening surface of said package; and a support element for transmitting movement of said lid to movement of said opening means, said support element designed to automatically raise itself into the hinged path of said lid upon the initial opening thereof;

wherein prior to opening of said package said opening means is held in a position substantially parallel to said opening surface; and wherein after the initial opening of said lid, said lid and said support element operate in conjunction during the initial closing of said lid to push said opening means through said opening surface of said package, thereby forming a pouring hole therein.

2. A pouring element according to claim 1, wherein said package is of cuboid, flat-gabled shape and is constructed from a composite material comprising an outer plastic layer, a carrier layer of paper or cardboard, a bonding agent layer, a barrier layer, and an inner plastic layer.

3. A pouring element according to claim 1, wherein said support element and said opening means are formed as one piece.

4. A pouring element according to claim 1, wherein said support element is bar-shaped.

5. A pouring element according to claim 1, wherein said support element is attached to said lid.

6. A pouring element according to claim 5, wherein said opening means is formed onto a free end of said support element.

7. A pouring element according to claim 5, wherein said support element and said lid are formed as one piece.

8. A pouring element according to claim 5, wherein said support element may be retained within said lid after the opening of said package.

9. A pouring element according to claim 5, wherein said opening means is substantially arrowhead shaped.

10. A pouring element according to claim 1, wherein prior to the opening of said package, said opening means is arranged in said pouring aperture and is hingedly connected to said base plate.

11. A pouring element according to claim 10, further comprising a catch element located on said opening means for causing said opening means to be retained within said package after the opening thereof.

12. A pouring element according to claim 10, wherein said support element is attached to said opening means and is held by said lid in a pre-tensioned position.

13. A pouring element according to claim 12, further comprising at least one retaining device hingedly connected to said support element, wherein during the opening of said package said at least one retaining device is hinged against said support element as said support element passes through said pouring hole, and further, wherein after said opening means is fully inserted into said package, said at least one retaining device hinges away from said support element until it contacts an interior portion of said package, thereby ensuring that said support element and said opening means remain in said package.

14. A pouring element according to claim 10, wherein said lid serves to limit the motion of said support element.

15. A pouring element according to claim 14, wherein said motion of said support element is limited by a rim on the underside of said lid.

* * * * *